United States Patent [19]

Huang

[11] Patent Number: 4,916,028

[45] Date of Patent: Apr. 10, 1990

[54] GAMMA TITANIUM ALUMINUM ALLOYS MODIFIED BY CARBON, CHROMIUM AND NIOBIUM

[75] Inventor: Shyh-Chin Huang, Latham, N.Y.

[73] Assignee: General Electric Company, Schenectady, N.Y.

[21] Appl. No.: 386,326

[22] Filed: Jul. 28, 1989

[51] Int. Cl.[4] ..... C22C 14/00

[52] U.S. Cl. ..... 428/614; 420/418

[58] Field of Search ..... 420/418; 428/614

[56] References Cited

U.S. PATENT DOCUMENTS

| | | | |
|---|---|---|---|
| 3,203,794 | 8/1965 | Jaffee et al. | 420/418 |
| 3,378,368 | 4/1968 | Minton et al. | 420/418 |
| 3,411,901 | 11/1968 | Winter | 420/418 |
| 3,986,868 | 10/1976 | Crossley | 420/418 |
| 4,040,129 | 8/1977 | Steinemann et al. | 420/418 |
| 4,279,650 | 7/1981 | Jackman et al. | 420/418 |
| 4,294,615 | 10/1981 | Blackburn et al. | 420/420 |
| 4,661,316 | 4/1987 | Hashimoto et al. | 420/420 |
| 4,842,819 | 6/1989 | Huang et al. | 420/418 |
| 4,842,820 | 6/1989 | Huang et al. | 420/418 |

*Primary Examiner*—L. Dewayne Rutledge
*Assistant Examiner*—David W. Schumaker
*Attorney, Agent, or Firm*—Paul E. Rochford; James C. Davis, Jr.; James Magee, Jr.

[57] ABSTRACT

A TiAl composition is prepared to have high strength and to have improved ductility by altering the atomic ratio of the titanium and aluminum to have what has been found to be a highly desirable effective aluminum concentration by addition of chromium, carbon and niobium according to the approximate formula $Ti_{51-43}Al_{46-50}Cr_2Nb_{1-5}C_{0.1}$.

12 Claims, 3 Drawing Sheets

GAMMA TITANIUM ALUMINUM ALLOYS MODIFIED BY CARBON, CHROMIUM AND NIOBIUM

CROSS REFERENCE TO RELATED APPLICATIONS

The subject application relates to copending applications as follows: Ser. Nos. 138,407, 4,836,983, 138,408, 138,476, 4,857,268, 138,481, 4,842,819, 138,486, filed Dec. 28, 1987; 4,842,820 Ser. No. 201,984, filed Jun. 3, 1988; 4,879,902 Ser. Nos. 252,622, 253,659, filed Oct. 3, 1988; Ser. No. 293,035, filed Jan. 3, 1989.

The texts of these related applications are incorporated herein by reference.

BACKGROUND OF THE INVENTION

The present invention relates generally to alloys of titanium and aluminum. More particularly, it relates to gamma alloys of titanium and aluminum which have been modified both with respect to stoichiometric ratio and with respect to addition of a combination of additive elements.

It is known that as aluminum is added to titanium metal in greater and greater proportions the crystal form of the resultant titanium aluminum composition changes. Small percentages of aluminum go into solid solution in titanium and the crystal form remains that of alpha titanium. At higher concentration of aluminum (including about 25 to 35 atomic %) an intermetallic compound $Ti_3Al$ is formed. The $Ti_3Al$ has an ordered hexagonal crystal form called alpha-2. At still higher concentrations of aluminum (including the range of 50 to 60 atomic % aluminum) another intermetallic compound, TiAl, is formed having an ordered tetragonal crystal form called gamma.

The alloy of titanium and aluminum having a gamma crystal form, and a stoichiometric ratio of approximately one, is an intermetallic compound having a high modulus, a low density, a high thermal conductivity, favorable oxidation resistance, and good creep resistance. The relationship between the modulus and temperature for TiAl compounds to other alloys of titanium and in relation to nickel base superalloys is shown in FIG. 2. As is evident from the figure, the TiAl has the best modulus of any of the titanium alloys. Not only is the TiAl modulus higher at higher temperature but the rate of decrease of the modulus with temperature increase is lower for TiAl than for the other titanium alloys. Moreover, the TiAl retains a useful modulus at temperatures above those at which the other titanium alloys become useless. Alloys which are based on the TiAl intermetallic compound are attractive lightweight materials for use where high modulus is required at high temperatures and where good environmental protection is also required.

One of the characteristics of TiAl which limits its actual application to such uses is a brittleness which is found to occur at room temperature. Also, the strength of the intermetallic compound at room temperature needs improvement improvement before the TiAl intermetallic compound can be exploited in certain structural component applications. Improvements of the TiAl intermetallic compound to enhance ductility and/or strength at room temperature are very highly desirable in order to permit use of the compositions at the higher temperatures for which they are suitable.

With potential benefits of use at light weight and at high temperatures, what is most desired in the TiAl compositions which are to be used is a combination of strength and ductility at room temperature. A minimum ductility of the order of one percent is acceptable for some applications of the metal composition but higher ductilities are much more desirable. A minimum strength for a composition to be useful is about 50 ksi or about 350 MPa. However, materials having this level of strength are of marginal utility for certain applications and higher strengths are often preferred for some applications.

The stoichiometric ratio of gamma TiAl compounds can vary over a range without altering the crystal structure. The aluminum content can vary from about 50 to about 60 atom percent. However, the properties of gamma TiAl compositions are, however, subject to very significant changes as a result of relatively small changes of one percent or more in the stoichiometric ratio of the titanium and aluminum ingredients. Also, the properties are similarly significantly affected by the addition of relatively similar small amounts of additive elements.

I have now discovered that further improvements can be made in the gamma TiAl intermetallic compounds by incorporating therein a combination of additive elements so that the composition contains a combination of these additive elements.

Furthermore, I have discovered that the composition including the combination of additive elements has a uniquely desirable combination of properties which include appreciably strength, a significantly higher ductility and a valuable oxidation resistance.

PRIOR ART

There is extensive literature on the compositions of titanium aluminum including the $Ti_3Al$ intermetallic compound, the TiAl intermetallic compounds and the $TiAl_3$ intermetallic compound. A patent, U.S. Pat. No. 4,294,615, entitled "TITANIUM ALLOYS OF THE TiAl TYPE" contains an extensive discussion of the titanium aluminide type alloys including the TiAl intermetallic compound. As is pointed out in the patent in column 1, starting at line 50, in discussing TiAl's advantages and disadvantages relative to $Ti_3Al$:

> "It should be evident that the TiAl gamma alloy system has the potential for being lighter inasmuch as it contains more aluminum. Laboratory work in the 1950's indicated that titanium aluminide alloys had the potential for high temperature use to about 1000° C. But subsequent engineering experience with such alloys was that, while they had the requisite high temperature strength, they had little or no ductility at room and moderate temperatures, i.e., from 20° to 550° C. Materials which are too brittle cannot be readily fabricated, nor can they withstand infrequent but inevitable minor service damage without cracking and subsequent failure. They are not useful engineering materials to replace other base alloys".

It is known that the alloy system TiAl is substantially different from $Ti_3Al$ (as well as from solid solution alloys of Ti) although both TiAl and $Ti_3Al$ are basically ordered titanium aluminum intermetallic compounds. As the '615 patent points out at the bottom of column 1:

"Those well skilled recognize that there is a substantial difference between the two ordered phases. Alloying and transformational behavior of $Ti_3Al$ resemble those of titanium, as the hexagonal crystal structures are very similar. However, the compound TiAl has a tetragonal arrangement of atoms and thus rather different alloying characteristics. Such a distinction is often not recognized in the earlier literature."

The '615 patent does describe the alloying Of TiAl with vanadium and carbon to achieve some property improvements in the resulting alloy.

The '615 patent also discloses in Table 2 alloy $T_2$A-112 which is a composition in atomic percent of Ti-45Al-5.0Nb but the patent does not describe the composition as having any beneficial properties.

A number of technical publications dealing with the titanium aluminum compounds as well as with the characteristics of these compounds are as follows:

1. E. S. Bumps, H. D. Kessler, and M. Hansen, "*Titanium-Aluminum System*", Journal of Metals, June 1952, pp. 609–614, TRANSACTIONS AIME, Vol. 194.

2. H. R. Ogden, D. J. Maykuth, W. L. Finlay, and R. I. Jaffee, "*Mechanical Properties of High Purity Ti-Al Alloys*", Journal of Metals, February 1953, pp. 267–272, TRANSACTIONS AIME, Vol. 197.

3. Joseph B. McAndrew, and H. D. Kessler, "*Ti-36 Pct Al as a Base for High Temperature Alloys*", Journal of Metals, October 1956, pp. 1348–1353, TRANSACTIONS AIME, Vol. 206.

The McAndrew reference discloses work under way toward development of a TiAl intermetallic gamma alloy. In Table II, McAndrew reports alloys having ultimate tensile strength of between 33 and 49 ksi as adequate "where designed stresses would be well below this level". This statement appears immediately above Table II. In the paragraph above Table IV, McAndrew states that tantalum, silver and (niobium) columbium have been found useful alloys in inducing the formation of thin protective oxides on alloys exposed to temperatures of up to 1200° C. FIG. 4 of McAndrew is a plot of the depth of oxidation against the nominal weight percent of niobium exposed to still air at 1200° C. for 96 hours. Just above the summary on page 1353, a sample of titanium alloy containing 7 weight % columbium (niobium) is reported to have displayed a 50% higher rupture stress properties than the TiAl-36 %Al used for comparison.

4. Patrick L. Martin, Madan G. Mendiratta, and Harry A. Lispitt, "Creep Deformation of TiAl and TiAl +W Alloys", Metallurgical Transactions A, Volume 14A (October 1983) pp. 2171–2174.

5. P. L. Martin, H. A. Lispitt, N. T. Nuhfer, and J. C. Williams, "*The Effects of Alloying on the Microstructure and Properties of $Ti_3Al$ and TiAl*", Titanium 80. (Published by American Society for Metals, Warrendale, PA), Vol. 2, pp. 1245–1254.

6. Tokuzo Tsujimoto, "*Research, Development, and Prospects of TiAl Intermetallic Compound Alloys*", Titanium and Zirconiummm, Vol. 33, No. 3, 159 (July 1985) pp. 1–19.

7. H. A. Lipsitt, "*Titanlum Aluminides—An Overview*", Mat.Res.Soc. Symposium Proc., Materials Research Society, Vol. 39 (1985) pp. 351–364.

8. S. H. Whang et al., "*Effect of Rapid Solidification in $Ll_0$TiAl Compound Alloys*", ASM Symposium Proceedings on Enhanced Properties in Struc.Metals Via Rapid Solidification, Materials Week (October 1986) pp. 1–7.

9. Izvestiya Akademii Nauk SSSR, Metally. No. 3 (1984) pp. 164–168.

10. P. L. Martin, H. A. Lipsitt, N. T. Nuhfer and J. C. Williams, "*The Effects of Alloying on the Microstructure and Properites of $Ti_3Al$ and TiAl*", *Tittanium* 80 (published by the American Society of Metals, Warrendale, PA), Vol. 2 (1980) pp. 1245–1254.

U.S. Pat. No. 3,203,794 (Jaffee) discloses many TiAl compositions. A carbon containing TiAl is indicated to be much harder than the base composition (320 vs. 200 Vickers hardness) and consequently to be much less ductile. As Jaffee states, starting at column 3, line 59:

"Carbon, oxygen and nitrogen have a potent hardening action when present even in small amounts. Thus, the hardness of the Ti-37.5%Al is increased from about 200 to 320 Vickers by additions of 0.25% of each of C, O and N."

U.S. Pat. No. 4,661,316 (Hashimoto) teaches doping TiAl with 0.1 to 5.0 weight percent of manganese, as well as doping TiAl with combinations of other elements with manganese. At column 2, line 58, Hashimoto suggests adding 0.02 to 0.12% carbon to the manganese doped TiAl. However, at line 63, Hashimoto indicates ductility is decreased in stating:

"The addition of carbon increases high-temperature strength although decreasing ductility."

Accordingly, the prior art teaches that the addition of carbon to a ductile TiAl composition decreases ductility.

BRIEF DESCRIPTION OF THE INVENTION

One object of the present invention is to provide a method of forming a titanium aluminum intermetallic compound having greatly improved ductility, and related other properties at room temperature.

Another object is to improve the ductility properties of titanium aluminum intermetallic compounds at low and intermediate temperatures.

Another object is to improve the combination of ductility of TiAl base compositions together with a set of other favorable properties.

Yet another object is to make improvements in a set of ductility and strength properties.

Other objects will be in part apparent, and in part pointed out, in the description which follows.

In one of its broader aspects, the objects of the present invention are achieved by providing a nonstoichiometric gamma TiAl base alloy, and adding a relatively low concentration of chromium; a low concentration of niobium and a lower concentration of carbon to the nonstoichiometric composition. Addition of chromium in the order of approximately 1 to 3 atomic percent; of niobium to the extent of 1 to 5 atomic percent and carbon to the extent of 0.05 to 0.3 percent is contemplated.

As used herein, the term "gamma TiAl base alloy" designates a base alloy including titanium and aluminum and which may include also, in addition to designated additives, other additives in kind and amount which do not interfere with or detract from the good combination of properties of the base alloy.

If the composition is rapidly solidified, it may be consolidated as by isostatic pressing and extrusion to form a solid composition of the present invention. However, the alloy of this invention may be produced in ingot form and may be processed by ingot metallurgy to achieve highly desirable combinations of ductility, strength and other beneficial properties.

BRIEF DESCRIPTION OF THE DRAWINGS

In the description which follows, the text will be made clearer if reference is made to the accompanying drawings in which.

DETAILED DESCRIPTION OF THE INVENTION

Figure 1:
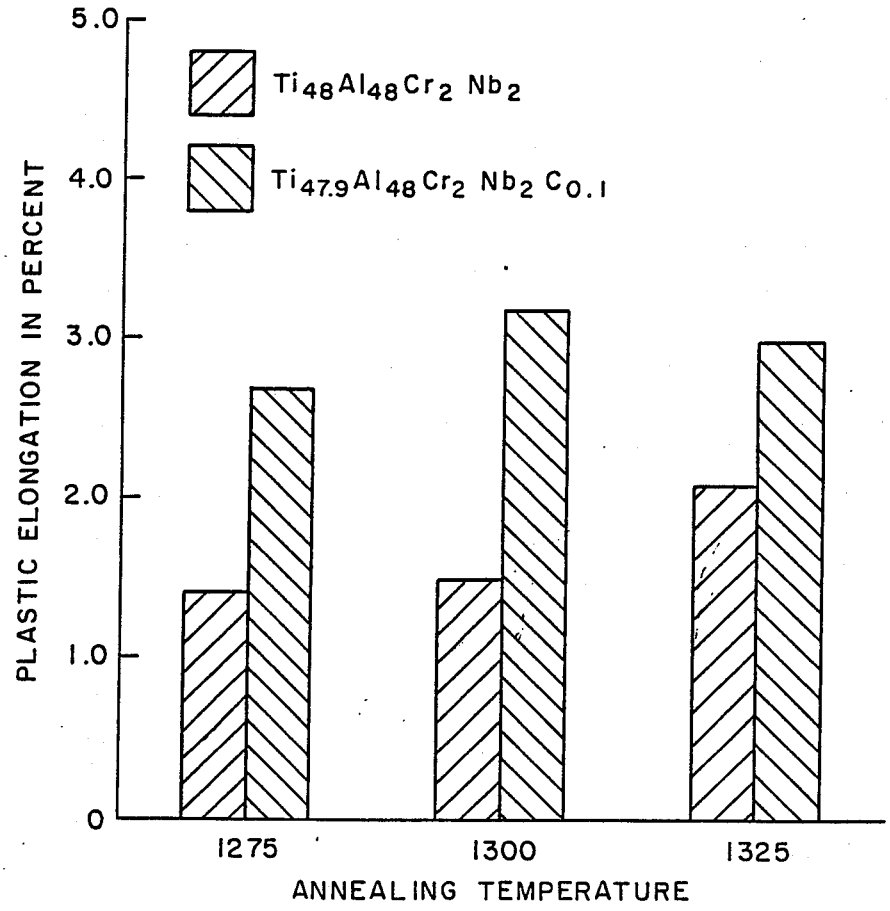
FIG. 1 is a bar graph displaying ductility for samples given different heat treatments.
Figure 2:
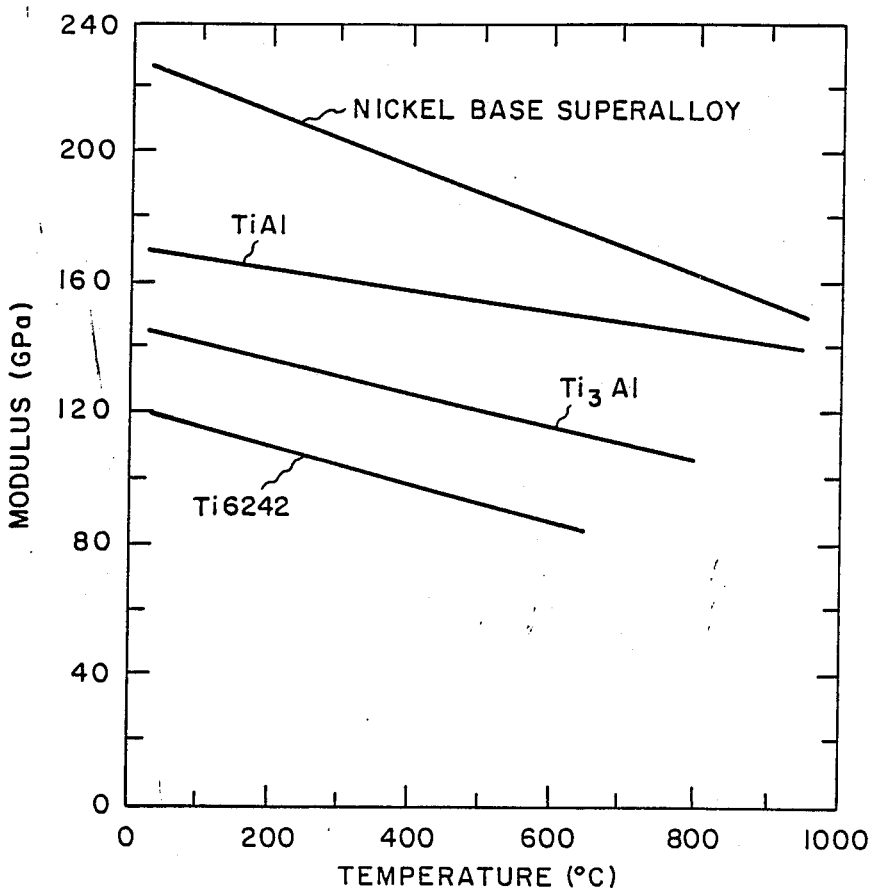
FIG. 2 is a graph illustrating the relationship between modulus and temperature for an assortment of alloys.

There are a series of background and current studies which led to the findings on which the present invention, involving the combined addition of carbon, niobium and chromium to a gamma TiAl are based. The first twenty five examples deal with the background studies and the later examples deal with the current studies.

EXAMPLES 1-3

Three individual melts were prepared to contain titanium and aluminum in various stoichiometric ratios approximating that of TiAl. The compositions, annealing temperatures and test results of tests made on the compositions are set forth in Table I.

For each example, the alloy was first made into an ingot by electro arc melting. The ingot was processed into ribbon by melt spinning in a partial pressure of argon. In both stages of the melting, a water-cooled copper hearth was used as the container for the melt in order to avoid undesirable melt-container reactions. Also, care was used to avoid exposure of the hot metal to oxygen because of the strong affinity of titanium for oxygen.

The rapidly solidified ribbon was packed into a steel can which was evacuated and then sealed. The can was then hot isostatically pressed (HIPped) at 950° C. (1740° F.) for 3 hours under a pressure of 30 ksi. The HIPping can was machined off the consolidated ribbon plug. The HIPped sample was a plug about one inch in diameter and three inches long.

The plug was placed axially into a center opening of a billet and sealed therein. The billet was heated to 975° C. (1787° F.) and was extruded through a die to give a reduction ratio of about 7 to 1. The extruded plug was removed from the billet and was heat treated.

The extruded samples were then annealed at temperatures as indicated in Table I for two hours. The annealing was followed by aging at 1000° C. for two hours. Specimens were machined to the dimension of 1.5 ×3 ×25.4 mm (0.060 ×0.120 ×1.0 in.) for four point bending tests at room temperature. The bending tests were carried out in a 4-point bending fixture having an inner span of 10 mm (0.4 in.) and an outer span of 20 mm (0.8 in.). The load-crosshead displacement curves were recorded. Based on the curves developed, the following properties are defined:

(1) Yield strength is the flow stress at a cross head displacement of one thousandth of an inch. This amount of cross head displacement is taken as the first evidence of plastic deformation and the transition from elastic deformation to plastic deformation. The measurement of yield and/or fracture strength by conventional compression or tension methods tends to give results which are lower than the results obtained by four point bending as carried out in making the measurements reported herein. The higher levels of the results from four point bending measurements should be kept in mind when comparing these values to values obtained by the conventional compression or tension methods. However, the comparison of measurements'results in many of the examples herein is between four point bending tests, and for all samples measured by this technique, such comparisons are quite valid in establishing the differences in strength properties resulting from differences in composition or in processing of the compositions.

(2) Fracture strength is the stress to fracture.

(3) Outer fiber strain is the quantity of 9.71hd, where"h" is the specimen thickness in inches, and"d" is the cross head displacement of fracture in inches. Metallurgically, the value calculated represents the amount of plastic deformation experienced at the outer surface of the bending specimen at the time of fracture.

The results are listed in the following Table I. Table I contains data on the properties of samples annealed at 1300° C. and further data on these samples in particular is given in FIG. 3.

TABLE I

| Ex. No. | Gamma Alloy No. | Composit. (at. %) | Anneal Temp (°C.) | Yield Strength (ksi) | Fracture Strength (ksi) | Outer Fiber Strain (%) |
|---|---|---|---|---|---|---|
| 1 | 83 | $Ti_{54}Al_{46}$ | 1250 | 131 | 132 | 0.1 |
| | | | 1300 | 111 | 120 | 0.1 |
| | | | 1350 | * | 58 | 0 |
| 2 | 12 | $Ti_{52}Al_{48}$ | 1250 | 130 | 180 | 1.1 |
| | | | 1300 | 98 | 128 | 0.9 |
| | | | 1350 | 88 | 122 | 0.9 |
| | | | 1400 | 70 | 85 | 0.2 |
| 3 | 85 | $Ti_{50}Al_{50}$ | 1250 | 83 | 92 | 0.3 |
| | | | 1300 | 93 | 97 | 0.3 |
| | | | 1350 | 78 | 88 | 0.4 |

Figure 3:
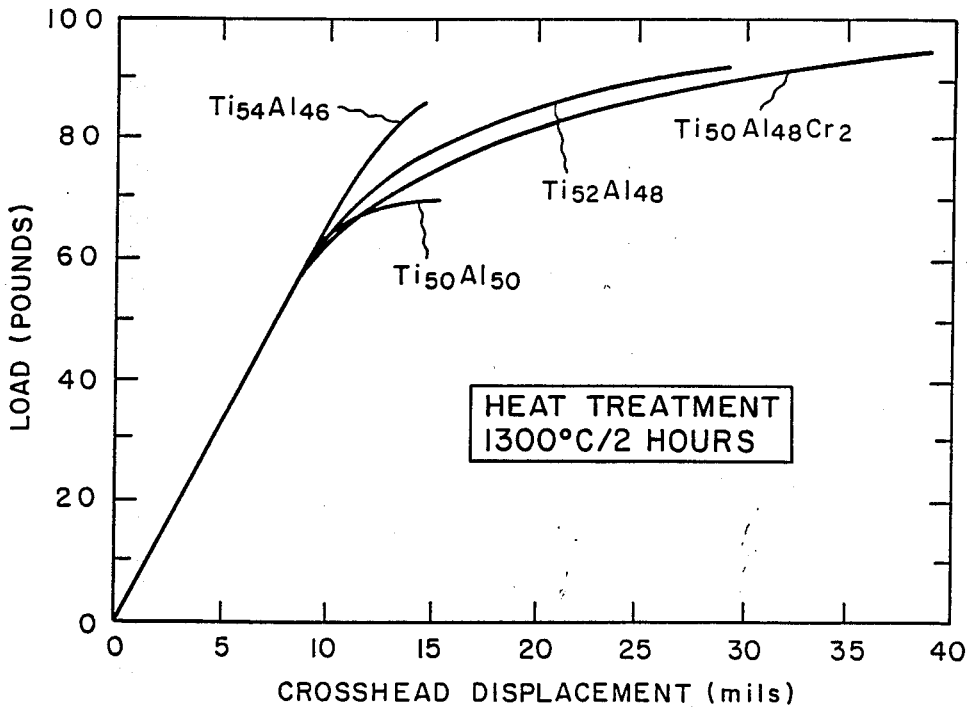
FIG. 3 is a graph illustrating the relationship between load in pounds and crosshead displacement in mils for TiAl compositions of different stoichiometry tested in 4-point bending.

* No measurable value was found because the sample lacked sufficient ductility to obtain a measurement A plot of the crosshead displacement in mils against applied load in pounds for these three alloys in relation to an alloy containing chromium additive is given in FIG. 3.

It is evident from the data of this Table and from FIG. 3 that alloy 12 for Example 2 exhibited the best combination of properties. This confirms that the properties of Ti-Al compositions are very sensitive to the Ti/Al atomic ratios and to the heat treatment applied. Alloy 12 was selected as the base alloy for further property improvements based on further experiments which were performed as described below.

It is also evident that the anneal at temperatures between 1250° C. and 1350° C. results in the test specimens having desirable levels of yield strength, fracture strength and outer fiber strain. However, the anneal at 1400° C. results in a test specimen having a significantly lower yield strength (about 20% lower); lower fracture strength (about 30% lower) and lower ductility (about 78% lower) than a test specimen annealed at 1350° C. The sharp decline in properties is due to a dramatic change in microstructure due, in turn, to an extensive beta transformation at temperatures appreciably above 1350° C.

EXAMPLES 4–13

Ten additional individual melts were prepared to contain titanium and aluminum in designated atomic ratios as well as additives in relatively small atomic percents.

Each of the samples was prepared as described above with reference to Examples 1–3.

The compositions, annealing temperatures, and test results of tests made on the compositions are set forth in Table II in comparison to alloy 12 as the base alloy for this comparison.

TABLE II

| Ex. No. | Gamma Alloy No. | Composition (at. %) | Anneal Temp (°C.) | Yield Strength (ksi) | Fracture Strength (ksi) | Outer Fiber Strain (%) |
|---|---|---|---|---|---|---|
| 2 | 12 | $Ti_{52}Al_{48}$ | 1250 | 130 | 180 | 1.1 |
| | | | 1300 | 98 | 128 | 0.9 |
| | | | 1350 | 88 | 122 | 0.9 |
| 4 | 22 | $Ti_{50}Al_{47}Ni_3$ | 1200 | * | 131 | 0 |
| 5 | 24 | $Ti_{52}Al_{46}Ag_2$ | 1200 | * | 114 | 0 |
| | | | 1300 | 92 | 117 | 0.5 |
| 6 | 25 | $Ti_{50}Al_{48}Cu_2$ | 1250 | * | 83 | 0 |
| | | | 1300 | 80 | 107 | 0.8 |
| | | | 1350 | 70 | 102 | 0.9 |
| 7 | 32 | $Ti_{54}Al_{45}Hf_1$ | 1250 | 130 | 136 | 0.1 |
| | | | 1300 | 72 | 77 | 0.2 |
| 8 | 41 | $Ti_{52}Al_{44}Pt_4$ | 1250 | 132 | 150 | 0.3 |
| 9 | 45 | $Ti_{51}Al_{47}C_2$ | 1300 | 136 | 149 | 0.1 |
| 10 | 57 | $Ti_{50}Al_{48}Fe_2$ | 1250 | * | 89 | 0 |
| | | | 1300 | * | 81 | 0 |
| | | | 1350 | 86 | 111 | 0.5 |
| 11 | 82 | $Ti_{50}Al_{48}Mo_2$ | 1250 | 128 | 140 | 0.2 |
| | | | 1300 | 110 | 136 | 0.5 |
| | | | 1350 | 80 | 95 | 0.1 |
| 12 | 39 | — $Ti_{50}Al_{46}Mo_4$ | 1200 | * | 143 | 0 |
| | | | 1250 | 135 | 154 | 0.3 |
| | | | 1300 | 131 | 149 | 0.2 |
| 13 | 20 | $Ti_{49.5}Al_{49.5}Er_1$ | + | + | + | + |

* See asterisk note to Table I
\+ Material fractured during machining to prepare test specimens Measurement of the properties of alloy 45 of Example 9 demonstrated that the addition of carbon to a ductile TiAl drastically reduced the ductility by about 90%.

For Examples 4 and 5, heat treated at 1200° C., the yield strength was unmeasurable as the ductility was found to be essentially nil. For the specimen of Example 5 which was annealed at 1300° C., the ductility increased, but it was still undesirably low.

For Example 6, the same was true for the test specimen annealed at 1250° C. For the specimens of Example 6 which were annealed at 1300° and 1350° C. the ductility was significant but the yield strength was low.

None of the test specimens of the other Examples were found to have any significant level of ductility.

It is evident from the results listed in Table II that the sets of parameters involved in preparing compositions for testing are quite complex and interrelated. One parameter is the atomic ratio of the titanium relative to that of aluminum. From the data plotted in FIG. 3, it is evident that the stoichiometric ratio or nonstoichiometric ratio has a strong influence on the test properties which formed for different compositions.

Another set of parameters is the additive chosen to be included into the basic TiAl composition. A first parameter of this set concerns whether a particular additive acts as a substituent for titanium or for aluminum. A specific metal may act in either fashion and there is no simple rule by which it can be determined which role an additive will play. The significance of this parameter is evident if we consider addition of some atomic percentage of additive X.

If X acts as a titanium substituent, then a composition $Ti_{48}Al_{48}X_4$ will give an effective aluminum concentration of 48 atomic percent and an effective titanium concentration of 52 atomic percent.

If, by contrast, the X additive acts as an aluminum substituent, then the resultant composition will have an effective aluminum concentration of 52 percent and an effective titanium concentration of 48 atomic percent.

Accordingly, the nature of the substitution which takes place is very important but is also highly unpredictable.

Another parameter of this set is the concentration of the additive.

Still another parameter evident from Table II is the annealing temperature. The annealing temperature which produces the best strength properties for one additive can be seen to be different for a different additive. This can be seen by comparing the results set forth in Example 6 with those set forth in Example 7.

In addition, there may be a combined concentration and annealing effect for the additive so that optimum property enhancement, if any enhancement is found, can occur at a certain combination of additive concentration and annealing temperature so that higher and lower concentrations and/or annealing temperatures are less effective in providing a desired property improvement.

The content of Table II makes clear that the results obtainable from addition of a ternary element to a nonstoichiometric TiAl composition are highly unpredictable and that most test results are unsuccessful with respect to ductility or strength or to both.

EXAMPLES 14–17:

A further parameter of the gamma titanium aluminide alloys which include additives is that combinations of additives do not necessarily result in additive combinations of the individual advantages resulting from the individual and separate inclusion of the same additives.

Four additional TiAl based samples were prepared as described above with reference to Examples 1-3 to contain individual additions of vanadium, niobium, and tantalum as listed in Table III. These compositions are the optimum compositions reported in copending applications Ser. Nos. 138,476, 138,408, and 138,485, respectively.

The fourth composition is a composition which combines the vanadium, niobium and tantalum into a single alloy designated in Table III to be alloy 48.

From Table III, it is evident that the individual additions vanadium, niobium and tantalum are able on an individual basis in Examples 14, 15, and 16 to each lend substantial improvement to the base TiAl alloy. However, these same additives when combined into a single combination alloy do not result in a combination of the individual improvements in an additive fashion. Quite the reverse is the case.

In the first place, the alloy 48 which was annealed at the 1350° C. temperature used in annealing the individual alloys was found to result in production of such a brittle material that it fractured during machining to prepare test specimens.

Secondly, the results which are obtained for the combined additive alloy annealed at 1250° C. are very inferior to those which are obtained for the separate alloys containing the individual additives.

In particular, with reference to the ductility, it is evident that the vanadium was very successful in substantially improving the ductility in the alloy 14 of Example 14. However, when the vanadium is combined with the other additives in alloy 48 of Example 17, the ductility improvement which might have been achieved is not achieved at all. In fact, the ductility of the base alloy is reduced to a value of 0.1.

Further, with reference to the oxidation resistance, the niobium additive of alloy 40 clearly shows a very substantial improvement in the 4 mg/cm$^2$ weight loss of alloy 40 as compared to the 31 mg/cm$^2$ weight loss of the base alloy. The test of oxidation, and the complementary test of oxidation resistance, involves heating a sample to be tested at a temperature of 982° C. for a period of 48 hours. After the sample has cooled, it is scraped to remove any oxide scale. By weighing the sample both before and after the heating and scraping, a weight difference can be determined. Weight loss is determined in mg/cm$^2$ by dividing the total weight loss in grams by the surface area of the specimen in square centimeters. This oxidation test is the one used for all measurements of oxidation or oxidation resistance as set forth in this application.

For the alloy 60 with the tantalum additive, the weight loss for a sample annealed at 1325° C. was determined to be 2 mg/cm$^2$ and this is again compared to the 31 mg/cm$^2$ weight loss for the base alloy. In other words, on an individual additive basis both niobium and tantalum additives were very effective in improving oxidation resistance of the base alloy.

However, as is evident from Example 17, results listed in Table III alloy 48 which contained all three additives, vanadium, niobium and tantalum in combination, the oxidation is increased to about double that of the base alloy. This is seven times greater than alloy 40 which contained the niobium additive alone and about 15 times greater than alloy 60 which contained the tantalum additive alone.

TABLE III

| Ex. No. | Gamma Alloy No. | Composit. (at. %) | Anneal Temp (°C.) | Yield Strength (ksi) | Fracture Strength (ksi) | Outer Fiber Strain (%) | Weight Loss After 48 hours @ 98° C. (mg/cm$^2$) |
|---|---|---|---|---|---|---|---|
| 2 | 12 | $Ti_{52}Al_{48}$ | 1250 | 130 | 180 | 1.1 | * |
| | | | 1300 | 98 | 128 | 0.9 | * |
| | | | 1350 | 88 | 122 | 0.9 | 31 |
| 14 | 14 | $Ti_{49}Al_{48}V_3$ | 1300 | 94 | 145 | 1.6 | 27 |
| | | | 1350 | 84 | 136 | 1.5 | * |
| 15 | 40 | $Ti_{50}Al_{46}Nb_4$ | 1250 | 136 | 167 | 0.5 | * |
| | | | 1300 | 124 | 176 | 1.0 | 4 |
| | | | 1350 | 86 | 100 | 0.1 | * |
| 16 | 60 | $Ti_{48}Al_{48}Ta_4$ | 1250 | 120 | 147 | 1.1 | * |
| | | | 1300 | 106 | 141 | 1.3 | * |
| | | | 1325 | * | * | * | * |
| | | | 1325 | * | * | * | 2 |
| | | | 1350 | 97 | 137 | 1.5 | * |
| | | | 1400 | 72 | 92 | 0.2 | * |
| 17 | 48 | $Ti_{49}Al_{45}V_2Nb_2Ta_2$ | 1250 | 106 | 107 | 0.1 | 60 |
| | | | 1350 | + | + | + | * |

* Not measured
\+ Material fractured during machining to prepare test specimen

The individual advantages or disadvantages which result from the use of individual additives repeat reliably as these additives are used individually over and over again. However, when additives are used in combination the effect of an additive in the combination in a base alloy can be quite different from the effect of the additive when used individually and separately in the same base alloy. Thus, it has been discovered that addition of vanadium is beneficial to the ductility of titanium aluminum compositions and this is disclosed and discussed in the copending application for patent Ser. No. 138,476. Further, one of the additives which has been found to be beneficial to the strength of the TiAl base and which is described in copending application Ser. No. 138,408, filed Dec. 28, 1987, as discussed above, is the additive niobium. In addition, it has been shown by the McAndrew paper discussed above that the individual addition of niobium additive to TiAl base alloy can improve oxidation resistance. Similarly, the individual addition of tantalum is taught by McAndrew as assisting in improving oxidation resistance. Furthermore, in copending application Ser. No. 138,485, it is disclosed that addition of tantalum results in improvements in ductility.

In other words, it has been found that vanadium can individually contribute advantageous ductility improvements to gamma titanium aluminum compound and that tantalum can individually contribute to ductility and oxidation improvements. It has been found separately that niobium additives can contribute beneficially to the strength and oxidation resistance properties of titanium aluminum. However, the Applicant has found, as is indicated from this Example 17, that when vanadium, tantalum, and niobium are used together and are combined as additives in an alloy composition, the alloy composition is not benefited by the additions but rather there is a net decrease or loss in properties of the TiAl which contains the niobium, the tantalum, and the vanadium additives. This is evident from Table III.

From this, it is evident that, while it may seem that if two or more additive elements individually improve TiAl that their use together should render further improvements to the TiAl, it is found, nevertheless, that such additions are highly unpredictable and that, in fact, for the combined additions of vanadium, niobium and tantalum a net loss of properties result from the combined use of the combined additives together rather than resulting in some combined beneficial overall gain of properties.

However, from Table III above, it is evident that the alloy containing the combination of the vanadium, niobium and tantalum additions has far worse oxidation resistance than the base TiAl 12 alloy of Example 2. Here, again, the combined inclusion of additives which improve a property on a separate and individual basis have been found to result in a net loss in the very property which is improved when the additives are included on a separate and individual basis.

EXAMPLES 18 thru 23:

Six additional samples were prepared as described above with reference to Examples 1–3 to contain chromium modified titanium aluminide having compositions respectively as listed in Table IV.

Table IV summarizes the bend test results on all of the alloys, both standard and modified, under the various heat treatment conditions deemed relevant.

TABLE IV

| Ex. No. | Gamma Alloy No. | Composition (at. %) | Anneal Temp (°C.) | Yield Strength (ksi) | Fracture Strength (ksi) | Outer Fiber Strain (%) |
|---|---|---|---|---|---|---|
| 2 | 12 | $Ti_{52}Al_{48}$ | 1250 | 130 | 180 | 1.1 |
| | | | 1300 | 98 | 128 | 0.9 |
| | | | 1350 | 88 | 122 | 0.9 |
| 18 | 38 | $Ti_{52}Al_{46}Cr_2$ | 1250 | 113 | 170 | 1.6 |
| | | | 1300 | 91 | 123 | 0.4 |
| | | | 1350 | 71 | 89 | 0.2 |
| 19 | 80 | $Ti_{50}Al_{48}Cr_2$ | 1250 | 97 | 131 | 1.2 |
| | | | 1300 | 89 | 135 | 1.5 |
| | | | 1350 | 93 | 108 | 0.2 |
| 20 | 87 | $Ti_{48}Al_{50}Cr_2$ | 1250 | 108 | 122 | 0.4 |
| | | | 1300 | 106 | 121 | 0.3 |
| | | | 1350 | 100 | 125 | 0.7 |
| 21 | 49 | $Ti_{50}Al_{46}Cr_4$ | 1250 | 104 | 107 | 0.1 |
| | | | 1300 | 90 | 116 | 0.3 |
| 22 | 79 | $Ti_{48}Al_{48}Cr_4$ | 1250 | 122 | 142 | 0.3 |
| | | | 1300 | 111 | 135 | 0.4 |
| | | | 1350 | 61 | 74 | 0.2 |
| 23 | 88 | $Ti_{46}Al_{50}Cr_4$ | 1250 | 128 | 139 | 0.2 |
| | | | 1300 | 122 | 133 | 0.2 |
| | | | 1350 | 113 | 131 | 0.3 |

The results listed in Table IV offer further evidence of the criticality of a combination of factors in determining the effects of alloying additions or doping additions on the properties imparted to a base alloy. For example, the alloy 80 shows a good set of properties for a 2 atomic percent addition of chromium. One might expect further improvement from further chromium addition. However, the addition of 4 atomic percent chromium to alloys having three different TiAl atomic ratios demonstrates that tee increase in concentration of an additive found to be beneficial at lower concentrations does not follow the simple reasoning that if some is good, more must be better. And, in fact, for the chromium additive just the opposite is true and demonstrates that where some is good, more is bad.

As is evident from Table IV, each of the alloys 49, 79 and 88, which contain "more" (4 atomic percent) chromium shows inferior strength and also inferior outer fiber strain (ductility) compared with the base alloy.

By contrast, alloy 38 of Example 18 contains 2 atomic percent of additive and shows only slightly reduced strength but greatly improved ductility. Also, it can be observed that the measured outer fiber strain of alloy 38 varied significantly with the heat treatment conditions. A remarkable increase in the outer fiber strain was achieved by annealing at 1250° C. Reduced strain was observed when annealing at higher temperatures. Similar improvements were observed for alloy 80 which also contained only 2 atomic percent of additive although the annealing temperature was 1300° C. for the highest ductility achieved.

For Example 20, alloy 87 employed the level of 2 atomic percent of chromium but the concentration of aluminum is increased to 50 atomic percent. The higher aluminum concentration leads to a small reduction in the ductility from the ductility measured for the two percent chromium compositions with aluminum in the 46 to 48 atomic percent range. For alloy 87, the optimum heat treatment temperature was found to be about 1350° C.

From Examples 18, 19 and 20, which each contained 2 atomic percent additive, it was observed that the optimum annealing temperature increased with increasing aluminum concentration.

From this data it was determined that alloy 38 which has been heat treated at 1250° C., had the best combination of room temperature properties. Note that the optimum annealing temperature for alloy 38 with 46 at.% aluminum was 1250° C. but the optimum for alloy 80 with 48 at.% aluminum was 1300° C. The data obtained for alloy 80 is plotted in FIG. 3 relative to the base alloys.

These remarkable increases in the ductility of alloy 38 on treatment at 1250° C. and of alloy 80 on heat treatment at 1300° C. were unexpected as is explained in the copending application for Ser. No. 138,485, filed Dec. 28, 1987.

What is clear from the data contained in Table IV is that the modification of TiAl compositions to improve the properties of the compositions is a very complex and unpredictable undertaking. For example, it is evident that chromium at 2 atomic percent level does very substantially increase the ductility of the composition where the atomic ratio of TiAl is in an appropriate range and where the temperature of annealing of the composition is in an appropriate range for the chromium additions. It is also clear from the data of Table IV that, although one might expect greater effect in improving properties by increasing the level of additive, just the reverse is the case because the increase in ductility which is achieved at the 2 atomic percent level is reversed and lost when the chromium is increased to the 4 atomic percent level. Further, it is clear that the 4 percent level is not effective in improving the TiAl properties even though a substantial variation is made in the atomic ratio of the titanium to the aluminum and a substantial range of annealing temperatures is employed in studying the testing the change in properties which attend the addition of the higher concentration of the additive.

EXAMPLE 24:

Samples of alloys were prepared which had a composition as follows:

$Ti_{52}Al_{46}Cr_2$.

Test samples of the alloy were prepared by two different preparation modes or methods and the properties of each sample were measured by tensile testing. The methods used and results obtained are listed in Table V immediately below.

TABLE V

| Ex. No. | Alloy No. | Composition (at. %) | Processing Method | Anneal Temp (°C.) | Yield Strength (ksi) | Tensile Strength (ksi) | Plastic Elongation (%) |
|---|---|---|---|---|---|---|---|
| 18 | 38 | $Ti_{52}Al_{46}Cr_2$ | Rapid Solidification | 1250 | 93 | 108 | 1.5 |
| 24 | 38 | $Ti_{52}Al_{46}Cr_2$ | Ingot Metallurgy | 1225 | 77 | 99 | 3.5 |
| | | | | 1250 | 74 | 99 | 3.8 |
| | | | | 1275 | 74 | 97 | 2.6 |

In Table V, the results are listed for alloy samples 38 which were prepared according to two Examples, 18 and 24, which employed two different and distinct alloy preparation methods in order to form the alloy of the respective examples. In addition, test methods were employed for the metal specimens prepared from the alloy 38 of Example 18 and separately for alloy 38 of Example 24 which are different from the test methods used for the specimens of the previous examples.

Turning now first to Example 18, the alloy of this example was prepared by the method set forth above with reference to Examples 1–3. This is a rapid solidification and consolidation method. In addition for Example 18, the testing was not done according to the 4 point bending test which is used for all of the other data reported in the tables above and particularly for Example 18 of Table IV above. Rather the testing method employed was a more conventional tensile testing according to which a metal samples are prepared as tensile bars and subjected to a pulling tensile test until the metal elongates and eventually breaks. For example, again with reference to Example 18 of Table V, the alloy 38 was prepared into tensile bars and the tensile bars were subjected to a tensile force until there was a yield or extension of the bar at 93 ksi.

The yield strength in ksi of Example 18 of Table V, measured by a tensile bar, compares to the yield strength in ksi of Example 18 of Table IV which was measured by the 4 point bending test. In general, in metallurgical practice, the yield strength determined by tensile bar elongation is a more generally used and more generally accepted measure for engineering purposes.

Similarly, the tensile strength in ksi of 108 represents the strength at which the tensile bar of Example 18 of Table V broke as a result of the pulling. This measure is referenced to the fracture strength in ksi for Example 18 in Table V. It is evident that the two different tests result in two different measures for all of the data.

With regard next to the plastic elongation, here again there is a correlation between the results which are determined by 4 point bending tests as set forth in Table IV above for Example 18 and the plastic elongation in percent set forth in the last column of Table V for Example 18.

Referring again now to Table V, the Example 24 is indicated under the heading "Processing Method" to be prepared by ingot metallurgy. As used herein, the term "ingot metallurgy" refers to a melting of the ingredients of the alloy 38 in the proportions set forth in Table V and corresponding exactly to the proportions set forth for Example 18. In other words, the composition of alloy 38 for both Example 18 and for Example 24 are identically the same. The difference between the two examples is that the alloy of Example 18 was prepared by rapid solidification and the alloy of Example 24 was prepared by ingot metallurgy. Again, the ingot metallurgy involves a melting of the ingredients and solidification of the ingredients into an ingot. The rapid solidification method involves the formation of a ribbon by the melt spinning method followed by the consolidation of the ribbon into a fully dense coherent metal sample.

In the ingot melting procedure of Example 24 the ingot is prepared to a dimension of about 2" in diameter and about ½ thick in the approximate shape of a hockey puck. Following the melting and solidification of the hockey puckshaped ingot, the ingot was enclosed within a steel annulus having a wall thickness of about ½ and having a vertical thickness which matched identically that of the hockey puckshaped ingot. Before being enclosed within the retaining ring the hockey puck ingot was homogenized by being heated to 1250° C. for two hours. The assembly of the hockey puck and containing ring were heated to a temperature of about 975° C. The heated sample and containing ring were forged to a thickness of approximately half that of the original thickness.

Following the forging and cooling of the specimen, tensile specimens were prepared corresponding to the tensile specimens prepared for Example 18. These tensile specimens were subjected to the same conventional tensile testing as was employed in Example 18 and the yield strength, tensile strength and plastic elongation measurements resulting from these tests are listed in Table V for Example 24. As is evident from the Table V results, the individual test samples were subjected to different annealing temperatures prior to performing the actual tensile tests.

For Example 18 of Table V, the annealing temperature employed on the tensile test specimen was 1250° C. For the three samples of the alloy 38 of Example 24 of Table V, the samples were individually annealed at the three different temperatures listed in Table V and specifically 1225° C., 1250° C., and 1275° C. Following this annealing treatment for approximately two hours, the samples were subjected to conventional tensile testing and the results again are listed in Table V for the three separately treated tensile test specimens.

Turning now again to the test results which are listed in Table V, it is evident that the yield strengths determined for the rapidly solidified alloy are somewhat higher than those which are determined for the ingot processed metal specimens. Also, it is evident that the plastic elongation of the samples prepared through the ingot metallurgy route have generally higher ductility than those which are prepared by the rapid solidification route. The results listed for Example 24 demonstrate that although the yield strength measurements are somewhat lower than those of Example 18 they are fully adequate for many applications in aircraft engines and in other industrial uses. However, based on the ductility measurements and the results of the measurements as listed in Table 24 the gain in ductility makes the alloy 38 as prepared through the ingot metallurgy route a very desirable and unique alloy for those applications which require a higher ductility. Generally speaking, it is well-known that processing by ingot metallurgy is far less expensive than processing through melt spinning or rapid solidification inasmuch as there is no need for the expensive melt spinning step itself nor for the consolidation step which must follow the melt spinning.

EXAMPLE 25:

Samples of an alloy containing both chromium additive and niobium additive were prepared as disclosed above with reference to Examples 1–3. As reported in copending application Ser. No. 201,984, filed Jun. 3, 1988, tests were conducted on the samples and the results are listed in Table VI immediately below.

TABLE VI*

| Ex. No. | Alloy No. | Composition (at. %) | Anneal Temp (°C.) | Yield Strength (ksi) | Tensile Strength (ksi) | Plastic Elongation (%) | Wt. Loss After 48 hrs @ 980° C. ($mg/cm^2$) |
|---|---|---|---|---|---|---|---|
| 2A** | 12A | $Ti_{52}Al_{48}$ | 1300 | 77 | 92 | 2.1 | + |
| | | | 1350 | + | + | + | 31 |
| 15 | 40 | $Ti_{50}Al_{46}Nb_4$ | 1300 | 87 | 100 | 1.6 | 4 |
| 19 | 80 | $Ti_{50}Al_{48}Cr_2$ | 1275 | + | + | + | 47 |
| | | | 1300 | 75 | 97 | 2.8 | + |
| 25 | 81 | $Ti_{48}Al_{48}Cr_2Nb_2$ | 1275 | 82 | 99 | 3.1 | 4 |
| | | | 1300 | 78 | 95 | 2.4 | + |
| | | | 1325 | 73 | 93 | 2.6 | + |

+ Not measured.

*The data in this Table is based on conventional tensile testing rather than on the four point bending as described above.

**Example 2A corresponds to Example 2 above in the composition of the alloy used in the example. However, Alloy 12A of Example 2A was prepared by ingot metallurgy rather than by the rapid solidification method of Alloy 12 of Example 2. The tensile and elongation properties were tested by the tensile bar method rather than the four point bending testing used for Alloy 12 of Example 2.

It is known from Example 17, in Table III above, that the addition of more than one additive elements, each of which is effective individually in improving and in contributing to an improvement of different properties of the TiAl compositions, that nonetheless, when more than one additive is employed in concert and combination, as is done in Example 17, the result is essentially negative in that the combined addition results in a decrease in desired overall properties rather than an increase. Accordingly, it is very surprising to find that by the addition of two elements and specifically chromium and niobium to bring the additive level of the TiAl to the 4 atomic percent level and employing a combination of two differently acting additives that a substantial further increase in the desirable overall property of the alloy of the TiAl composition is achieved. In fact, the highest ductility levels achieved in all of the tests on materials prepared by the Rapid Solidification Technique are those which are achieved through use of the combined chromium and niobium additive combination.

A further set of tests were done in connection with the alloys and these tests concern the oxidation resistance of the alloys. In this test, the weight loss after 48 hours of heating at 982° C. in air were measured. The measurement was made in milligrams per square centimeter of surface of the test specimen. The results of the tests are also listed in Table VI.

From the data given in Table VI, it is evident that the weight loss from the heating of alloy 12 was about 31 $mg/cm^2$. Further, it is evident that the weight loss from the heating of alloy 80 containing chromium above was 47 $mg/cm^2$. By contrast, the weight loss resulting from the heating of the alloy 81 annealed at 1275° C. was about 4 $mg/cm^2$. This decrease in the level of weight loss represents an increase in the oxidation resistance of the alloy. This is a very remarkable increase of about seven fold from the combination of chromium and niobium additives in the alloy 81. Accordingly, what is found in relation to the chromium and niobium containing alloy is that it has a very desirable level of ductility and the highest achieved together with a very substantial improvement and level of oxidation resistance.

The alloy is suitable for use in components such as components of jet engines which display high strength at high temperatures. Such components may be, for example, swirlless, exhaust components, LPT blades or vanes, components, vanes or ducts.

The alloy may also be employed in reinforced composite structures substantially as described in copending application Ser. No. 010,882, filed Feb. 4, 1987, and assigned to the same assignee as the subject application the text of which application is incorporated herein by reference.

EXAMPLE 26:

The alloy described in Example 25 was prepared by rapid solidification. By contrast, the alloy of this example was prepared by ingot metallurgy in a manner similar to that described in Example 24 above.

The specific preparation method is important in achieving an improvement in properties over the properties of the composition as described in copending application Ser. No. 201,984, filed Jun. 3, 1988.

The proportions of the ingredient of this alloy are as follows:

$Ti_{48}Al_{48}Cr_2Nb_2$.

The ingredients were melted together and then solidified into two ingots about 2 inches in diameter and about 0.5 inches thick. The melts for these ingots were prepared by electro-arc melting in a copper hearth.

The first of the two ingots was homogenized for 2 hours at 1250° C. and the second was homogenized at 1400° C. for two hours.

After homogenization, each ingot was individually fitted to a close fitting annular steel ring having a wall thickness of about ½ inch. Each of the ingots and its containing ring was heated to 975° C. and was then forged to a thickness about half that of the original thickness.

Both forged samples were then annealed at temperatures between 1250? C. and 1350? C. for two hours. Following the annealing, the forged samples were aged at 1000? C. for two hours. After the aging, the sample ingots were machined into tensile bars for tensile tests at room temperature.

Table VII below summarizes the results of the room temperature tensile tests.

TABLE VII*

Room Temperature Tensile Properties of Cast-and-Forged $Ti_{48}Al_{48}Cr_2Nb_2$

| Ex. | Ingot Homogenizatn Temperature (°C.) | Tensile Specimen Heat Treatment Temp. (°C.) | Yield Strength (ksi) | Fracture Strength (ksi) | Plastic Elongatn (%) |
|---|---|---|---|---|---|
| 26A | 1250 | 1275 | 61 | 70 | 1.4 |
| | | 1300 | 67 | 74 | 1.5 |
| | | 1325 | 62 | 76 | 2.1 |
| | | 1350 | 65 | 61 | 1.3 |
| 26B | 1400 | 1275 | 64 | 77 | 2.7 |
| | | 1300 | 63 | 77 | 2.8 |

TABLE VII*-continued

Room Temperature Tensile Properties of Cast-and-Forged $Ti_{48}Al_{48}Cr_2Nb_2$

| Ex. | Ingot Homogenizatn Temperature (°C.) | Tensile Specimen Heat Treatment Temp. (°C.) | Yield Strength (ksi) | Fracture Strength (ksi) | Plastic Elongatn (%) |
|---|---|---|---|---|---|
| | | 1325 | 60 | 76 | 2.9 |

*-The data in this Table is based on conventional tensile testing rather than on the four-point bending as described in Examples 1-23 above From the data included in Table VI above an in Table VII here, it is evident that it has been demonstrated experimentally that a strong ductile TiAl base alloy having high resistance to oxidation has been prepared by cast and wrought metallurgy techniques.

The yield strengths are in the 60 to 67 ksi range and it is noteworthy that these yield strengths are quite independent of homogenization and heat treatment temperatures which were applied. By contrast, the ductilities are seen to be strongly dependent on the homogenization temperatures used. Thus, when the 1250° C. homogenization temperature is used, the ductilities measured range from 1.3 to 2.1% depending on the heat treatment temperature.

However, when the homogenization is performed at 1400° C., the ductilities achieved in the samples are at the higher values of 2.7 to 2.9%. These ductilities are significantly higher and, furthermore, are significantly more consistent than those found from measurements of the materials homogenized at the lower temperature.

These tests demonstrate that the ductility of a $Ti_{48}Al_{48}Cr_2Nb_2$ composition prepared by cast-and-forged metallurgy techniques are greatly improved by homogenization at 1400° C.

The foregoing example demonstrates the preparation of a composition having a unique combination of ductility, strength and oxidation resistance. This example is disclosed in copending application Ser. No. 354,965, filed May 22,1989.

Moreover, the preparation is by a low cost ingot metallurgy method as distinct from the more expensive melt spinning method used in Example 25.

The method is unique to the composition doped with the combination of chromium and niobium. The concentration ranges of the chromium and niobium for which the subject method of this example will produce advantageous results is as follows:

$Ti_{48}Al_{48}Cr_2Nb_2$.

The homogenization of the ingot prior to thickness reduction is preferably carried out at a temperature of about 1400° C. but homogenization at temperatures above the transus temperature in practicing the method is feasible. It will be realized that the transus temperature will vary depending on the stoichiometric ratio of the titanium and the aluminum and on specific concentrations of the chromium and niobium additives. For this reason, it is advisable to first determine the transus temperature of a particular composition and to use this value in carrying out the method.

Homogenization times may vary inversely with the temperature employed but shorter times of the order of one to three hours are preferred.

Following the homogenization and enclosing of the ingot, the assembly of ingot and containing ring are heated to 975° C. prior to the reduction in thickness through forging. Successful forging can be accomplished without any containing ring and with samples heated to temperatures between about 900° C. and the incipient melting temperature. Temperatures above the incipient melting point should be avoided.

The reduction in thickness step is not limited to a reduction to one half the original thickness. Reductions of from about 10% and higher produce useful results in practicing the present invention. A reduction above 50% is preferred.

Annealing, following the thickness reduction, can be carried out over a range of temperatures from about 1250° C. to the transus temperature, and preferably from about 1250° C. to about 1350° C., and over a range of times from about one hour to about 10 hours, and preferably in the shorter time ranges of about one to three hours. Samples annealed at higher temperatures are preferably annealed for shorter times to achieve essentially the same effective anneal.

Aging may be carried out after the annealing. Aging is usually done at a lower temperature than the annealing and for a short time in the order of one or a few hours. Aging at 1000° C. for one hour is a typical aging treatment. Aging is helpful but not essential to practice of the present invention.

The foregoing was explained in the copending application Ser. No. 354965 filed May 22,1989 which application is incorporated herein by reference.

EXAMPLE 27:

A sample of an alloy containing carbon additive in addition to chromium and niobium was prepared according to the formula:

$$Ti_{47.9}Al_{48}Cr_2Nb_2C_{0.1}.$$

The composition was prepared and tested as described in Examples 24 and 26A. This included electro arc melting and casting into an ingot about 2 inches in diameter and ½ inch thick. The cast ingot was homogenized for 2 hours at 1250° C. and then enclosed in a steel ring. The ingot and ring were heated to 975° C. and the ingot and ring were then forged to a thickness approximately half that of the original thickness.

After annealing at temperatures between 1200° and 1400° C. for 2 hours, and aging at 1000° C. for 2 hours, specimens were machined for tensile tests at room temperature. The results of the tests are contained in the Table VIII immediately below together with the results of the tensile testing of alloy 81 of Example 26A. These two sets of test data are included in Table VIII as the two alloys had been prepared and processed through the same set of processing steps so that the results of their respective tests are quite closely comparable.

TABLE VIII

Room Temperature Tensile Properties of Cast-and-Forged Alloys

| Ex. No. | Gamma Alloy No. | Composition (at. %) | Anneal Temp (°C.) | Yield Strength (ksi) | Fracture Strength (ksi) | Plastic Elongtn (%) |
|---|---|---|---|---|---|---|
| 26A | 81 | $Ti_{48}Al_{48}Cr_2Nb_2$ | 1275 | 61 | 70 | 1.4 |
| | | | 1300 | 67 | 74 | 1.5 |
| | | | 1325 | 62 | 76 | 2.1 |
| | | | 1350 | 65 | 71 | 1.3 |
| 27 | 185 | $Ti_{47.9}Al_{48}Cr_2Nb_2C_{0.1}$ | 1275 | 64 | 77 | 2.7 |
| | | | 1300 | 63 | 81 | 3.2 |
| | | | 1325 | 64 | 82 | 3.0 |

From the results tabulated in Table VIII, it is evident that the addition of carbon to the chromium and niobium doped gamma TiAl produced most remarkable increases in ductility. These results are plotted in FIG. 1.

What is evident from Table VIII and FIG. 1 is that the remarkably good ductility of the alloy 81 annealed at 1275° and 1300° C. and containing the combination of the chromium and niobium additives was incredibly doubled by the further addition of 0.1 atom percent of carbon.

Clearly, this is a most unusual and unexpected result.

Accordingly, from the foregoing, it is evident that there are a plurality of ways of providing improvements in the ductility of a TiAl composition which has chromium and niobium additives included therein.

A first way is through the use of rapid solidification processing. By itself the rapid solidification route of preparing a $Ti_{48}Al_{48}Cr_2Nb_2$ composition favors the development of higher ductility.

A second method is the method of Example 26B which involves homogenization at 1400° C.

The third method is the one taught herein and specifically the inclusion of carbon along with chromium and niobium in the TiAl composition.

As indicated from the foregoing, each of these techniques are effective in improving the ductility of the TiAl.

Regarding the precise composition containing carbon where a composition such as $$Ti_{47.9}Al_{48}Cr_2Nb_2C_{0.1}$$

is provided, the carbon substituent and the base composition TiAl into which the carbon is substituted may be expressed as fixed and certain. However, this is not equally true in a composition such as:

$$Ti_{52\text{-}42}Al_{46\text{-}50}Cr_{1\text{-}3}Nb_{1\text{-}5}C_{0.05\text{-}0.2}$$

where there are many variables for each constituent. For convenience of notation in such a composition, the decimal values of the titanium ingredient are not indicated. Rather, reliance is placed on the clear designation of the carbon constituent with the understanding that the concentration value of the titanium constituent will be the complement of whatever carbon value is designated. Thus, if the carbon value is 0.2 the titanium value will be [(52 to 42)-0.2]. Where the carbon concentration value is 0.05 the titanium concentration value will be [(52 to 42)-0.05].

What is claimed and sought to be protected by Letters Patent of the United States is as follows:

1. A chromium, carbon and niobium modified gamma titanium aluminum base alloy consisting essentially of titanium, aluminum, chromium, niobium and carbon in the following approximate atomic ratio:

$Ti_{52-42}Al_{46-50}Cr_{1-3}Nb_{1-5}C_{0.05-0.2}$.

2. A chromium, carbon and niobium modified gamma titanium aluminum base alloy consisting essentially of titanium, aluminum, chromium, niobium and carbon in the following approximate atomic ratio:

$Ti_{51-43}Al_{46-50}Cr_2Nb_{1-5}C_{0.05-0.2}$.

3. A chromium, carbon and niobium modified gamma titanium aluminum base alloy consisting essentially of titanium, aluminum, chromium, niobium and carbon in the approximate atomic ratio of:

$Ti_{51-43}Al_{46-50}Cr_2Nb_{1-5}C_{0.1}$.

4. A chromium, carbon and niobium modified gamma titanium aluminum base alloy consisting essentially of titanium, aluminum, chromium, niobium and carbon in the approximate atomic ratio of:

$Ti_{50-46}Al_{46-50}Cr_2Nb_2C_{0.1}$.

5. The alloy of claim 1, said alloy having been cast-and-forged.

6. The alloy of claim 2, said alloy having been cast-and-forged.

7. The alloy of claim 3, said alloy having been cast-and-forged.

8. The alloy of claim 4, said alloy having been cast-and-forged.

9. A structural component for use at high strength and high temperature, said component being formed of a chromium, niobium and carbon modified titanium aluminum alloy consisting essentially of titanium, aluminum, chromium, niobium, and carbon in the following approximate atomic ratio:

$Ti_{51-43}Al_{46-50}Cr_2Nb_{1-5}C_{0.1}$.

10. The component of claim 9, wherein the component is a structural component of a jet engine.

11. The component of claim 9, wherein the component is reinforced by filamentary reinforcement.

12. The component of claim 11, wherein the filamentary reinforcement is silicon carbide filaments.

* * * * *